US008591671B2

(12) United States Patent
Shimazu et al.

(10) Patent No.: US 8,591,671 B2
(45) Date of Patent: Nov. 26, 2013

(54) NON-ORIENTED ELECTRICAL STEEL SHEET

(75) Inventors: Takahide Shimazu, Tokyo (JP); Hotaka Honma, Tokyo (JP); Yousuke Kurosaki, Tokyo (JP); Hisashi Mogi, Tokyo (JP); Kenji Kosuge, Tokyo (JP); Takeaki Wakisaka, Tokyo (JP)

(73) Assignee: Nippon Steel & Sumitomo Metal Corporation, Tokyo (JP)

( * ) Notice: Subject to any disclaimer, the term of this patent is extended or adjusted under 35 U.S.C. 154(b) by 0 days.

(21) Appl. No.: 13/578,853

(22) PCT Filed: Feb. 21, 2011

(86) PCT No.: PCT/JP2011/053676

§ 371 (c)(1),
(2), (4) Date: Aug. 14, 2012

(87) PCT Pub. No.: WO2011/105327

PCT Pub. Date: Sep. 1, 2011

(65) Prior Publication Data

US 2012/0321502 A1 Dec. 20, 2012

(30) Foreign Application Priority Data

Feb. 25, 2010 (JP) ..... 2010-039867

(51) Int. Cl.
*C22C 38/34* (2006.01)
*C22C 38/22* (2006.01)

(52) U.S. Cl.
USPC ..... 148/309; 148/307; 148/310

(58) Field of Classification Search
USPC ..... 148/307–310, 110–113
See application file for complete search history.

(56) References Cited

U.S. PATENT DOCUMENTS

| | | | | |
|---|---|---|---|---|
| 5,783,143 | A * | 7/1998 | Handa et al. | 420/52 |
| 7,377,986 | B2 | 5/2008 | Schoen et al. | |
| 7,922,834 | B2 | 4/2011 | Tanaka et al. | |
| 2010/0158744 | A1 | 6/2010 | Murakami | |
| 2011/0094699 | A1 | 4/2011 | Miyazaki et al. | |

FOREIGN PATENT DOCUMENTS

| | | |
|---|---|---|
| EP | 1 577 413 | 9/2005 |
| EP | 1816226 | 4/2011 |
| JP | 2-093043 | 4/1990 |
| JP | 6-108149 | 4/1994 |
| JP | 11-229095 | 8/1999 |
| JP | 2000-119822 | 4/2000 |
| JP | 2001-200347 | 7/2001 |
| JP | 2001-288542 | 10/2001 |
| JP | 2002-212688 | 7/2002 |
| JP | 2002-212689 | 7/2002 |
| JP | 2002-241907 | 8/2002 |
| JP | 2002-294417 | 10/2002 |
| JP | 2003-027195 | 1/2003 |
| JP | 2003-096548 | 4/2003 |
| JP | 2003-183788 | 7/2003 |
| JP | 2003-247020 | 9/2003 |
| JP | 2003-247052 | 9/2003 |
| JP | 2007-162062 | 6/2007 |
| JP | 2007-516345 | 6/2007 |
| KR | 10-2008-0027913 | 3/2008 |
| KR | 10-2009-0014383 | 2/2009 |
| WO | 01/98550 | 12/2001 |
| WO | 2010/010801 | 1/2010 |

OTHER PUBLICATIONS

Machine-English translation of Japanese patent 2003-247052, Yamagami Nobuo, Sep. 5, 2003.*
Machine-English translation of Japanese patent 2002-212688, Oda Yoshihiko et al., Jul. 31, 2002.*
Machine-English translation of Japanese patent 2002-080948, Oda Yoshihiko et al, Mar. 22, 2002.*
Taiwanese Office Action, dated Oct. 17, 2012, issued in corresponding Taiwanese Patent Application No. 100106011.
International Preliminary Report on Patentability dated Sep. 27, 2012 issued in corresponding PCT Application No. PCT/JP2011/053676.
Korean Office Action, dated Dec. 10, 2012, issued in corresponding Korean Patent Application No. 10-2012-7021514 with English summary.
International Search Report dated Apr. 19, 2011, issued in corresponding PCT Application No. PCT/JP2011/053676.
Extended European Search Report dated Sep. 30, 2013 issued in corresponding EP Application No. 11 74 7288.

* cited by examiner

*Primary Examiner* — Deborah Yee
(74) *Attorney, Agent, or Firm* — Kenyon & Kenyon LLP

(57) ABSTRACT

A non-oriented electrical steel sheet contains Cr: 0.3 mass % to 5.3 mass %, Si: 1.5 mass % to 4 mass %, Al: 0.4 mass % to 3 mass %, and W: 0.0003 mass % to 0.01 mass %. A C content is 0.006 mass % or less, a Mn content is 1.5 mass % or less, a S content is 0.003 mass % or less, and a N content is 0.003 mass % or less, and the balance is composed of Fe and inevitable impurities.

4 Claims, No Drawings

NON-ORIENTED ELECTRICAL STEEL SHEET

This application is a national stage application of International Application No. PCT/JP2011/053676, filed Feb. 21, 2011, which claims priority to Japanese Application No. 2010-039867, filed Feb. 25, 2010, the content of which is incorporated by reference herein in its entirety.

TECHNICAL FIELD

The present invention relates to a non-oriented electrical steel sheet suitable for a iron core material of a motor.

BACKGROUND ART

In recent years, due to a demand for energy saving, a further reduction in power consumption is required of motors of air-conditioners, driving motors for electric vehicles, and so on in fields of electric apparatuses using non-oriented electrical steel sheets. Further, PWM (pulse width modulation) waveform controlling, on which harmonics are superimposed by an inverter, has become dominant in motor driving in place of ON-OFF controlling with electric current. Accordingly, a non-oriented electrical steel sheet has come to be required to have an excellent high-frequency characteristic.

Conventionally, for the purpose of improving a high-frequency core loss of a non-oriented electrical steel sheet, specific resistance has been increased by an increase of contents of Si, Al, and Cr, and a thickness of the non-oriented electrical steel sheet has been reduced as much as possible. These can reduce an eddy current loss.

However, in a non-oriented electrical steel sheet containing Cr, a Cr-based carbide precipitates during manufacturing processes, working processes after the manufacture, and so on, and then a core loss increases and is deteriorated. The Cr-based carbide sometimes precipitates during annealing in the manufacturing processes. Further, a customer side using a non-oriented electrical steel sheet sometimes performs combustion and disappearance of stamping oil, shrink fit for manufacturing a split core, strain relief annealing, and so on. These workings and so on are performed at relatively low temperatures of about 200° C. to 750° C., and during these workings, the Cr-based carbide sometimes precipitates to grain boundaries.

Therefore, in order to suppress the precipitation of the Cr-based carbide in the non-oriented electrical steel sheet containing Cr, an art to make Mo contained therein has been proposed (Patent Document 1). However, in the art, a content of expensive Mo is 0.05 mass % or more, resulting in a great increase in material cost.

CITATION LIST

Patent Literature

Patent Literature 1: Japanese Laid-open Patent Publication No. 2002-294417

Patent Literature 2: Japanese Laid-open Patent Publication No. 2007-162062

Patent Literature 3: Japanese Laid-open Patent Publication No. 06-108149

Patent Literature 4: Japanese Laid-open Patent Publication No. 2002-241907

Patent Literature 5: Japanese Translation of PCT Publication No. 2007-516345

SUMMARY OF INVENTION

Technical Problem

It is an object of the present invention to provide a non-oriented electrical steel sheet which is capable of having an improved high-frequency characteristic yet costing less.

Solution to Problem

The gist of the present invention is as follows.

(1) A non-oriented electrical steel sheet containing:

Cr: 0.3 mass % to 5.3 mass %;

Si: 1.5 mass % to 4 mass %;

Al: 0.4 mass % to 3 mass %; and

W: 0.0003 mass % to 0.01 mass %, a C content being 0.006 mass % or less, a Mn content being 1.5 mass % or less, a S content being 0.003 mass % or less, and a N content being 0.003 mass % or less, and the balance being composed of Fe and inevitable impurities.

(2) The non-oriented electrical steel sheet described in (1) further containing at least one kind of elements selected from a group consisting of:

Mo: 0.001 mass % to 0.03 mass %;

Ti: 0.0005 mass % to 0.007 mass %; and

Nb: 0.0002 mass % to 0.004 mass %.

(3) The non-oriented electrical steel sheet described in (1) or (2) further containing at least one kind of elements selected from a group consisting of:

V: 0.0005 mass % to 0.005 mass %;

Zr: 0.0003 mass % to 0.003 mass %;

Cu: 0.001 mass % to 0.2 mass %;

Sn: 0.001 mass % to 0.2 mass %;

Ni: 0.001 mass % to 0.2 mass %;

Sb: 0.001 mass % to 0.2 mass %;

rare earth metal: 0.0002 mass % to 0.004 mass %; and

Ca: 0.0005 mass % to 0.006 mass %.

Advantageous Effects of Invention

According to the present invention, even though Cr is contained, owing to an appropriate amount of W contained, it is possible to increase specific resistance while avoiding embrittlement and to suppress the precipitation of a Cr-based carbide and magnetic aging to improve a high-frequency characteristic at low cost.

DESCRIPTION OF EMBODIMENTS

Cr, similarly to Si and Al, increases specific resistance of a non-oriented electrical steel sheet. Further, Cr makes it difficult for the non-oriented electrical steel sheet to become brittle, unlike Si and Al. On the other hand, in a non-oriented electrical steel sheet containing Cr, especially in a non-oriented electrical steel sheet whose Cr content is 0.3 mass % or more, a Cr-based carbide is likely to precipitate at temperatures of about 200° C. to 700° C. The Cr-based carbide precipitates in a thin piece shape to grain boundaries to obstruct domain wall displacement. That greatly deteriorates a core loss under a high frequency of especially 400 Hz or more. The Cr-based carbide does not precipitate at high temperatures of 750° C. or higher and precipitates at low temperatures of about 200° C. to 700° C.

The present inventors studiously studied a technique to suppress the precipitation of a Cr-based carbide such as (Cr, $Fe)_7C_3$. As a result, it has been found out that in a non-oriented electrical steel sheet containing W besides Cr, the precipitation of a Cr-based carbide is suppressed owing to interaction of W and Cr, so that core loss deterioration is suppressed. A reason for the phenomenon is not clear at present, but a possible reason is that W being a carbide-forming element effectively acts on a precipitation behavior of the Cr-based carbide. It has been further found out that, when Mo, Ti, and/or Nb are(is) further contained besides Cr and W, interaction of these elements and Cr further suppresses the precipitation of the Cr-based carbide. A reason for the phenomenon is not clear at present either, but a possible reason is that Mo, Ti, and/or Nb being carbide-forming element(s) effectively act(s) on the precipitation behavior of the Cr-based carbide.

Though details will be described later, when a non-oriented electrical steel sheet whose Cr content is low contains W, a W-based carbide precipitates, and even if recrystallization annealing is performed at a temperature of about 800° C. to 1100° C., the growth of crystal grains is inhibited and it is difficult for crystal grains with a desired size to be obtained. The phenomenon also applies to Mo, Ti, and Nb. Therefore, it is important that the Cr content is equal to a predetermined value or more. Incidentally, since the temperature at which the Cr-based carbide precipitates is low as described above, the recrystallization annealing at the temperature of about 800° C. to 1100° C. does not cause the precipitation of the Cr-based carbide. Therefore, the inhibition to the growth of the crystal gains due to the Cr-based carbide is less likely to occur.

Further, the present inventors have found out that in a non-oriented electrical steel sheet containing appropriate amounts of Cr and W, so-called magnetic aging, that is, the precipitation of $Fe_3C$ (cementite) at, for example, 200° C. or lower is also suppressed. The present inventors have further found out that, when appropriate amount(s) of Mo, Ti, and/or Nb are(is) contained, the precipitation of $Fe_3C$ is more suppressed. The magnetic aging is a phenomenon that a core loss gradually deteriorates in accordance with a temperature increase during the rotation of a motor, and it is very preferable to make the magnetic aging difficult to occur in advance.

An embodiment of the present invention will be hereinafter described in more detail.

A non-oriented electrical steel sheet according to the embodiment contains Cr: 0.3 mass % to 5.3 mass %, Si: 1.5 mass % to 4 mass %, Al: 0.4 mass % to 3 mass %, and W: 0.0003 mass % to 0.01 mass %. Further, a C content is 0.006 mass % or less, a Mn content is 1.5 mass % or less, a S content is 0.003 mass % or less, and a N content is 0.003 mass % or less. The balance is composed of Fe and inevitable impurities.

When the C content is over 0.006 mass %, it is difficult to sufficiently suppress the precipitation of a Cr-based carbide even if appropriate amounts of W and so on are contained. Due to an influence of the precipitated Cr-based carbide, a high-frequency characteristic, especially a high-frequency characteristic at low temperatures, deteriorates. Further, C will be a cause of magnetic aging. Therefore, the C content is set to 0.006 mass % or less. It takes a great cost to industrially reduce the C content to less than 0.0005 mass %. Therefore, the C content is preferably 0.0005 mass % or more.

Cr increases specific resistance of the non-oriented electrical steel sheet while avoiding embrittlement. When the Cr content is less than 0.3 mass %, it is difficult to sufficiently obtain the effect. Further, when the Cr content is less than 0.3 mass %, carbides of W and so on are likely to precipitate, so that the growth of crystal grains in recrystallization annealing is likely to be inhibited. On the other hand, when the Cr content is over 5.3 mass %, it is difficult to sufficiently suppress the precipitation of the Cr-based carbide even if appropriate amounts of W and so on are contained. Due to an influence of the precipitated Cr-based carbide, a high-frequency characteristic, especially a high-frequency characteristic at low temperatures deteriorates. Therefore, the Cr content is set to 0.3 mass % to 5.3 mass %. Note that in order to sufficiently obtain the aforesaid effects, the Cr-content is preferably 0.5 mass % or more, and more preferably 1.6 mass % or more. Further, in order to reduce the precipitation of the Cr-based carbide, the Cr content is preferably 5.0 mass % or less, more preferably 2.5 mass % or less, and still more preferably 2.1 mass % or less.

Si increases specific resistance to improve a high-frequency core loss. When the Si content is less than 1.5 mass %, it is difficult to sufficiently obtain the effect. On the other hand, when the Si content is over 4 mass %, cold working is difficult due to embrittlement. Therefore, the Si content is set to 1.5 mass % to 4 mass %. In order to more reduce the high-frequency core loss, the Si content is preferably over 2 mass %.

Al increases specific resistance to improve a high-frequency core loss. When the Al content is less than 0.4 mass %, it is difficult to sufficiently obtain the effect. On the other hand, when the Al content is over 3 mass %, cold working is difficult due to embrittlement. Further, as the Al content is higher, magnetic flux density reduces more, resulting in more deterioration. Therefore, the Al content is set to 0.4 mass % to 3 mass %.

When the Mn content is over 1.5 mass %, embrittlement is noticeable. Therefore, the Mn content is set to 1.5 mass % or less. On the other hand, when the Mn content is 0.05 mass % or more, specific resistance is effectively increased and a core loss is reduced. Therefore, the Mn content is preferably 0.05 mass % or more.

When the S content is over 0.003 mass %, the formation of a sulfide such as MnS is noticeable, which accordingly inhibits domain wall displacement to deteriorate a magnetic property. Therefore, the S content is set to 0.003 mass % or less. It takes a great cost to industrially reduce the S content to less than 0.0002 mass %. Therefore, the S content is preferably 0.0002 mass % or more.

When the N content is over 0.003 mass %, the formation of a nitride is noticeable, which accordingly deteriorates the magnetic property. Further, when the N content is over 0.003 mass %, a swollen surface defect called a blister sometimes occurs during casting of steel. Therefore, the N content is set to 0.003 mass % or less. It takes a great cost to industrially reduce the N content to less than 0.0004 mass %. Therefore, the N content is preferably 0.0004 mass % or more.

W forms a carbide by reacting with C to suppress the precipitation of the Cr-based carbide. W can also suppress magnetic aging. When the W content is less than 0.0003 mass %, it is difficult to sufficiently obtain the effects, and a large amount of the Cr-based carbide precipitates to grain boundaries and so on. On the other hand, when the W content is over 0.01 mass %, an amount of the W-based carbide is excessive and magnetism deteriorates. Therefore, the W content is set to 0.0003 mass % to 0.01 mass %. In order to further suppress the precipitation of the Cr-based carbide, the W content is preferably 0.0005 mass % or more. Further, since a 0.005 mass % W content is high enough to suppress the precipitation of the Cr-based carbide, the W content is preferably 0.005 mass % or less in view of cost. In a non-oriented electrical steel sheet whose Si content is 2 mass % or less, when the Cr content is less than 0.3 mass %, the growth of crystal grains may be inhibited in accordance with the precipitation of the W-based carbide and magnetism deteriorates. Therefore, when W is contained in the non-oriented electrical steel sheet whose Si content is 2 mass % or less, it is important that the Cr content is 0.3 mass % or more.

According to the non-oriented electrical steel sheet according to the embodiment described above, even though Cr is contained, owing to an appropriate amount of W contained, it is possible to increase specific resistance while avoiding embrittlement and to suppress the precipitation of the Cr-based carbide and magnetic aging to improve the high-frequency characteristic at low cost. Therefore, the embodiment is suitable for use under high-frequencies.

In a low Si-based non-oriented electrical steel sheet scarcely containing Cr, the growth of crystal grains is inhibited in accordance with the precipitation of a W-based carbide, but in the embodiment, the W-based carbide is very difficult to precipitate since 0.3 mass % Cr or more is contained. Consequently, by actively utilizing W, it is possible to suppress the precipitation of the Cr-based carbide to improve the magnetic property.

It is preferable that the non-oriented electrical steel sheet according to the embodiment further contains at least one kind selected from a group consisting of Mo: 0.001 mass % to 0.03 mass %, Ti: 0.0005 mass % to 0.007 mass %, and Nb: 0.0002 mass % to 0.004 mass %.

Mo, similarly to W, forms a carbide by reacting with C to suppress the, precipitation of the Cr-based carbide. Mo can also suppress magnetic aging. When the Mo content is less than 0.001 mass %, it is difficult to sufficiently obtain the effects. On the other hand, when the Mo content is over 0.03 mass %, an amount of the Mo-based carbide is excessive and magnetism deteriorates. Therefore, the Mo content is preferably 0.001 mass % to 0.03 mass %. In order to further suppress the precipitation of the Cr-based carbide, the Mo content is more preferably 0.002 mass % or more. Further, since a 0.02 mass % Mo content is high enough to suppress the precipitation of the Cr-based carbide, the Mo content is more preferably 0.02 mass % or less in view of cost.

Ti, similarly to W, forms a carbide by reacting with C to suppress the precipitation of the Cr-based carbide. Ti can also suppress magnetic aging. When the Ti content is less than 0.0005 mass %, it is difficult to sufficiently obtain the effects. On the other hand, when the Ti content is over 0.007 mass %, an amount of the Ti-based carbide is excessive and magnetism deteriorates. Therefore, the Ti content is preferably 0.0005 mass % to 0.007 mass %. In order to further suppress the precipitation of the Cr-based carbide, the Ti content is more preferably 0.0007 mass % or more. Further, in order to suppress the excessive precipitation of the Ti-based carbide, the Ti content is more preferably 0.005 mass % or less.

Nb, similarly to W, forms a carbide by reacting with C to suppress the precipitation of the Cr-based carbide. Nb can also suppress magnetic aging. When the Nb content is less than 0.0002 mass %, it is difficult to sufficiently obtain the effects. On the other hand, when the Nb content is over 0.004 mass %, an amount of the Nb-based carbide is excessive and the growth of the crystal grains in the recrystallization annealing is inhibited. Therefore, the Nb content is preferably 0.0002 mass % to 0.004 mass %. In order to further suppress the precipitation of the Cr-based carbide, the Nb content is more preferably 0.0003 mass % or more. Further, in order to suppress the excessive precipitation of the Nb-based carbide, the Nb content is more preferably 0.0035 mass % or less.

Incidentally, Mo, Ti, and Nb exhibit the same operations as those of W as described above, but W is more effective than Mo, Ti, and Nb. Further, when Mo, Ti, and/or Nb whose content(s) is(are) within the above-described range(s) is(are) contained, the inhibition to the growth of the crystal grains in the recrystallization annealing due to the W-based carbide is more difficult to occur compared with a case where none of these is contained. Therefore, at least one kind selected from a group consisting of Mo, Ti, and Nb is preferably contained, and it is especially preferable that these three kinds of elements are all contained. Because the precipitation of the Cr-based carbide and the precipitation of cementite (magnetic aging) are especially effectively suppressed when Mo, Ti, and/or Nb are(is) contained besides W.

The non-oriented electrical steel sheet according to the embodiment may further contain at least one kind selected from a group consisting of V: 0.0005 mass % to 0.005 mass %, Zr: 0.0002 mass % to 0.003 mass %, Cu: 0.001 mass % to 0.2 mass %, Sn: 0.001 mass % to 0.2 mass %, Ni: 0.001 mass % to 0.2 mass %, Sb: 0.001 mass % to 0.2 mass %, REM (rare earth metal): 0.0002 mass % to 0.004 mass %, and Ca: 0.0005 mass % to 0.006 mass %.

V, similarly to W, forms a carbide by reacting with C to suppress the precipitation of the Cr-based carbide. When the V content is less than 0.0005 mass %, it is difficult to sufficiently obtain the effect. On the other hand, even when the V content is over 0.005 mass %, the effect worth the content cannot be obtained and cost greatly increases. Further, an amount of the V-based carbide is excessive and the growth of the crystal grains in the recrystallization annealing is sometimes inhibited. Therefore, the V content is preferably 0.0005 mass % to 0.005 mass %.

Zr, similarly to W, forms a carbide by reacting with C to suppress the precipitation of the Cr-based carbide. When the Zr content is less than 0.0002 mass %, it is difficult to sufficiently obtain the effect. On the other hand, even when the Zr content is over 0.003 mass %, the effect worth the content cannot be obtained and cost greatly increases. Further, an amount of the Zr-based carbide is excessive and the growth of the crystal grains in the recrystallization annealing is sometimes inhibited. Therefore, the Zr content is preferably 0.0002 mass % to 0.003 mass %.

Cu, Sn, Ni, and Sb improve texture. Regarding each of these elements, when the content is less than 0.001 mass %, it is difficult to sufficiently obtain the effect, and when the content is over 0.2 mass %, cost increases. Therefore, the Cu, Sn, Ni, and Sb contents are each preferably 0.001 mass % to 0.2 mass %.

REM and Ca form a coarse oxy-sulfide to render S harmless. When the REM content is less than 0.0002 mass % and when the Ca content is less than 0.0005 mass %, it is difficult to sufficiently obtain the effect. On the other hand, when the REM content is over 0.004 mass % and when the Ca content is over 0.006 mass %, cost increases. Therefore, the REM content is preferably 0.0002 mass % to 0.004 mass %, and the Ca content is preferably 0.0005 mass % to 0.006 mass %.

As described above, when V and/or Zr are(is) also contained, it is possible to further suppress the precipitation of the Cr-based carbide, and magnetic aging at lower temperatures of 750° C. or lower, for instance, can be further suppressed. Further, these W, Mo, Ti, Nb, V, Zr, and so on can be contained in the non-oriented electrical steel sheet by the addition to molten steel or the like. Therefore, it is well possible to industrially produce such a non-oriented electrical steel sheet.

Next, a method of manufacturing the non-oriented electrical steel sheet will be described.

First, molten steel with the above-described composition is fabricated by adjusting components, a slab is fabricated from the molten steel, and the slab is heated to be hot-rolled, by an ordinary method. A temperature for heating the slab is not particularly limited, and is preferably a low temperature of, for example, about 950° C. to 1230° C. in order to suppress the formation of minute precipitates. A thickness of a hot-rolled sheet obtained through the hot rolling is not particularly limited, and is, for example, about 0.8 mm to 3.0 mm.

Next, the hot-rolled sheet is annealed (hot-rolled sheet annealing) when necessary. The hot-rolled sheet annealing may improve magnetic flux density to reduce a hysteresis loss. A temperature of the hot-rolled sheet annealing is not particularly limited, and is preferably about 800° C. to 1100° C., for instance.

Cold rolling follows thereafter. A thickness of a cold-rolled sheet obtained through the cold rolling is not particularly limited, and is preferably a thin thickness of about 0.1 mm to 0.35 mm, for instance, in order to obtain a more excellent high-frequency magnetic property. When the thickness of the cold-rolled sheet is over 0.35 mm, an eddy current loss may be large and a high-frequency core loss may be likely to deteriorate. Further, when the thickness of the cold-rolled sheet is less than 0.1 mm, productivity may be likely to lower.

After the cold rolling, the cold-rolled sheet is degreased and is annealed for recrystallization, whereby the crystal grains are grown. In the recrystallization annealing, continuous annealing is performed, for instance. An annealing temperature is not particularly limited, and is, for example, about 800° C. to 1100° C. A size of the crystal grains after the recrystallization annealing is preferably about 30 μm to 120 μm. Note that, in the embodiment, as a result of the recrystallization annealing, the whole surface of the steel sheet preferably has a recrystallized texture in a ferrite single phase.

Subsequently, an insulating film is formed by application of a predetermined coating solution and baking. As the insulating film, for example, an organic insulating film, an inorganic insulating film, or a mixed insulating film containing an inorganic substance and an organic substance is formed.

The non-oriented electrical steel sheet may be manufactured in the above-described manner.

The manufactured non-oriented electrical steel sheet is, for example, shipped and worked by a customer. In the working, stamping into a shape for iron core, stacking, shrink fit, strain relief annealing at about 700° C. to 800° C., and so on may be performed, for instance. By a series of these workings, a core of a motor may be formed. Incidentally, the non-oriented electrical steel sheet not subjected to the strain relief annealing after the stacking is sometimes called a full-processed material, and the non-oriented electrical steel sheet subjected to the strain relief annealing is sometimes called a semi-processed material.

EXAMPLE

Next, experiments conducted by the present inventors will be described. Conditions and so on in these experiments are examples adopted in order to confirm the feasibility and effects of the present invention, and the present invention is not limited to these examples.

First, a vacuum furnace in a laboratory is used to fabricate molten steels containing components listed in Table 1 and Table 2, with the balance composed of Fe and inevitable impurities, and the molten steels were cast, whereby crude steel materials were obtained. Numerical values surrounded by heavy lines in Table 1 indicate that the numerical values fall out of the ranges defined in the present invention. Next, the crude steel materials were hot-rolled, whereby hot-rolled sheets each with a 2 mm thickness were obtained. Thereafter, hot-rolled sheet annealing was performed at 1000° C. for one minute in a $N_2$ gas atmosphere. Then, pickling and cold rolling followed, whereby cold-rolled sheets each with a 0.30 mm thickness were obtained. Next, recrystallization annealing was performed in a mixed gas atmosphere of 50% $H_2$ gas and 50% $N_2$ gas. In the recrystallization annealing, 30-second soaking was performed at 1000° C. Thereafter, samples each having a 100 mm side were stamped from the steel sheets having subjected to the recrystallization annealing.

TABLE 1

| SAMPLE | COMPONENTS (MASS %) | | | | | | | | | | | | | |
|---|---|---|---|---|---|---|---|---|---|---|---|---|---|---|
| No. | C | Cr | Si | Al | Mn | S | N | W | Mo | Ti | Nb | V | Zr | APPENDIX |
| 1 | 0.0005 | 2.1 | 2.3 | 1.2 | 0.6 | 0.001 | 0.0014 | 0.004 | 0.01 | 0.004 | 0.002 | 0.001 | 0.0006 | EXAMPLE |
| 2 | 0.0058 | 2.1 | 2.3 | 1.2 | 0.6 | 0.001 | 0.0014 | 0.004 | 0.01 | 0.004 | 0.002 | 0.001 | 0.0006 | EXAMPLE |
| 3 | 0.0082 | 2.1 | 2.3 | 1.2 | 0.6 | 0.001 | 0.0014 | 0.004 | 0.01 | 0.004 | 0.002 | 0.001 | 0.0006 | COMPARATIVE EXAMPLE |
| 4 | 0.0095 | 2.1 | 2.3 | 1.2 | 0.6 | 0.001 | 0.0014 | 0.004 | 0.01 | 0.004 | 0.002 | 0.001 | 0.0006 | COMPARATIVE EXAMPLE |
| 5 | 0.0035 | 0.2 | 1.9 | 1.4 | 0.1 | 0.003 | 0.0005 | 0.005 | 0.001 | 0.002 | 0.0002 | 0.005 | 0.0003 | COMPARATIVE EXAMPLE |
| 6 | 0.0035 | 0.4 | 1.9 | 1.4 | 0.1 | 0.003 | 0.0005 | 0.005 | 0.001 | 0.002 | 0.0002 | 0.005 | 0.0003 | EXAMPLE |
| 7 | 0.0035 | 1.6 | 1.9 | 1.4 | 0.1 | 0.003 | 0.0005 | 0.005 | 0.001 | 0.002 | 0.0002 | 0.005 | 0.0003 | EXAMPLE |
| 8 | 0.0035 | 6.0 | 1.9 | 1.4 | 0.1 | 0.003 | 0.0005 | 0.005 | 0.001 | 0.002 | 0.0002 | 0.005 | 0.0003 | EXAMPLE |
| 9 | 0.0035 | 5.4 | 1.9 | 1.4 | 0.1 | 0.003 | 0.0005 | 0.005 | 0.001 | 0.002 | 0.0002 | 0.005 | 0.0003 | COMPARATIVE EXAMPLE |
| 10 | 0.0035 | 8.5 | 1.9 | 1.4 | 0.1 | 0.003 | 0.0005 | 0.005 | 0.001 | 0.002 | 0.0002 | 0.005 | 0.0003 | COMPARATIVE EXAMPLE |
| 11 | 0.0057 | 2.5 | 3.2 | 0.7 | 0.2 | 0.0002 | 0.0014 | 0.0001 | 0.0003 | 0.0001 | 0 | 0.0001 | 0 | COMPARATIVE EXAMPLE |
| 12 | 0.0057 | 2.5 | 3.2 | 0.7 | 0.2 | 0.0002 | 0.0014 | 0.0003 | 0.0003 | 0.0001 | 0 | 0.0001 | 0 | EXAMPLE |
| 13 | 0.0057 | 2.5 | 3.2 | 0.7 | 0.2 | 0.0002 | 0.0014 | 0.0005 | 0.0003 | 0.0001 | 0 | 0.0001 | 0 | EXAMPLE |
| 14 | 0.0057 | 2.5 | 3.2 | 0.7 | 0.2 | 0.0002 | 0.0014 | 0.006 | 0.0003 | 0.0001 | 0 | 0.0001 | 0 | EXAMPLE |
| 15 | 0.0057 | 2.5 | 3.2 | 0.7 | 0.2 | 0.0002 | 0.0014 | 0.010 | 0.0003 | 0.0001 | 0 | 0.0001 | 0 | EXAMPLE |
| 16 | 0.0057 | 2.5 | 3.2 | 0.7 | 0.2 | 0.0002 | 0.0014 | 0.013 | 0.0003 | 0.0001 | 0 | 0.0001 | 0 | COMPARATIVE EXAMPLE |
| 17 | 0.0042 | 5.0 | 1.5 | 0.4 | 0.5 | 0.002 | 0.0027 | 0.003 | 0.0008 | 0.0001 | 0.004 | 0.0001 | 0.0001 | EXAMPLE |
| 18 | 0.0042 | 5.0 | 1.5 | 0.4 | 0.5 | 0.002 | 0.0027 | 0.003 | 0.0012 | 0.0001 | 0.004 | 0.0001 | 0.0001 | EXAMPLE |
| 19 | 0.0042 | 5.0 | 1.5 | 0.4 | 0.5 | 0.002 | 0.0027 | 0.003 | 0.003 | 0.0001 | 0.004 | 0.0001 | 0.0001 | EXAMPLE |
| 20 | 0.0042 | 5.0 | 1.5 | 0.4 | 0.5 | 0.002 | 0.0027 | 0.003 | 0.020 | 0.0001 | 0.004 | 0.0001 | 0.0001 | EXAMPLE |

TABLE 1-continued

| SAMPLE | COMPONENTS (MASS %) | | | | | | | | | | | | | |
|---|---|---|---|---|---|---|---|---|---|---|---|---|---|---|
| No. | C | Cr | Si | Al | Mn | S | N | W | Mo | Ti | Nb | V | Zr | APPENDIX |
| 21 | 0.0042 | 5.0 | 1.5 | 0.4 | 0.5 | 0.002 | 0.0027 | 0.003 | 0.030 | 0.0001 | 0.004 | 0.0001 | 0.0001 | EXAMPLE |
| 22 | 0.0042 | 5.0 | 1.5 | 0.4 | 0.5 | 0.002 | 0.0027 | 0.003 | 0.033 | 0.0001 | 0.004 | 0.0001 | 0.0001 | COMPARATIVE EXAMPLE |
| 23 | 0.0042 | 5.0 | 1.5 | 0.4 | 0.5 | 0.002 | 0.0027 | 0.003 | 0.05 | 0.0001 | 0.004 | 0.0001 | 0.0001 | COMPARATIVE EXAMPLE |
| 24 | 0.0038 | 1.1 | 3.3 | 2.5 | 1.4 | 0.002 | 0.0011 | 0.01 | 0.02 | 0.0003 | 0.0001 | 0.003 | 0.002 | EXAMPLE |
| 25 | 0.0038 | 1.1 | 3.3 | 2.5 | 1.4 | 0.002 | 0.0011 | 0.01 | 0.02 | 0.0007 | 0.0001 | 0.003 | 0.002 | EXAMPLE |
| 26 | 0.0038 | 1.1 | 3.3 | 2.5 | 1.4 | 0.002 | 0.0011 | 0.01 | 0.02 | 0.0032 | 0.0001 | 0.003 | 0.002 | EXAMPLE |
| 27 | 0.0038 | 1.1 | 3.3 | 2.5 | 1.4 | 0.002 | 0.0011 | 0.01 | 0.02 | 0.0069 | 0.0001 | 0.003 | 0.002 | EXAMPLE |
| 28 | 0.0038 | 1.1 | 3.3 | 2.5 | 1.4 | 0.002 | 0.0011 | 0.01 | 0.02 | 0.0074 | 0.0001 | 0.003 | 0.002 | COMPARATIVE EXAMPLE |
| 29 | 0.0015 | 1.6 | 2.8 | 0.6 | 0.1 | 0.001 | 0.003 | 0.0007 | 0.005 | 0.003 | 0.0001 | 0 | 0.001 | EXAMPLE |
| 30 | 0.0015 | 1.6 | 2.8 | 0.6 | 0.1 | 0.001 | 0.003 | 0.0007 | 0.005 | 0.003 | 0.0002 | 0 | 0.001 | EXAMPLE |
| 31 | 0.0015 | 1.6 | 2.8 | 0.6 | 0.1 | 0.001 | 0.003 | 0.0007 | 0.005 | 0.003 | 0.0020 | 0 | 0.001 | EXAMPLE |
| 32 | 0.0015 | 1.6 | 2.8 | 0.6 | 0.1 | 0.001 | 0.003 | 0.0007 | 0.005 | 0.003 | 0.0040 | 0 | 0.001 | EXAMPLE |
| 33 | 0.0015 | 1.6 | 2.8 | 0.6 | 0.1 | 0.001 | 0.003 | 0.0007 | 0.005 | 0.003 | 0.0045 | 0 | 0.001 | COMPARATIVE EXAMPLE |
| 34 | 0.0051 | 0.5 | 4.0 | 1.7 | 0.3 | 0.001 | 0.0004 | 0.001 | 0.01 | 0.002 | 0.0007 | 0.0003 | 0.001 | EXAMPLE |
| 35 | 0.0051 | 0.5 | 4.0 | 1.7 | 0.3 | 0.001 | 0.0004 | 0.001 | 0.01 | 0.002 | 0.0007 | 0.0005 | 0.001 | EXAMPLE |
| 36 | 0.0051 | 0.5 | 4.0 | 1.7 | 0.3 | 0.001 | 0.0004 | 0.001 | 0.01 | 0.002 | 0.0007 | 0.0021 | 0.001 | EXAMPLE |
| 37 | 0.0051 | 0.5 | 4.0 | 1.7 | 0.3 | 0.001 | 0.0004 | 0.001 | 0.01 | 0.002 | 0.0007 | 0.0049 | 0.001 | EXAMPLE |
| 38 | 0.0051 | 0.5 | 4.0 | 1.7 | 0.3 | 0.001 | 0.0004 | 0.001 | 0.01 | 0.002 | 0.0007 | 0.0056 | 0.001 | COMPARATIVE EXAMPLE |
| 39 | 0.0051 | 0.5 | 4.0 | 1.7 | 0.3 | 0.001 | 0.0004 | 0.001 | 0.01 | 0.002 | 0.0007 | 0.0001 | 0.0001 | EXAMPLE |
| 40 | 0.0051 | 0.5 | 4.0 | 1.7 | 0.3 | 0.001 | 0.0004 | 0.001 | 0.01 | 0.002 | 0.0007 | 0.0001 | 0.0003 | EXAMPLE |
| 41 | 0.0051 | 0.5 | 4.0 | 1.7 | 0.3 | 0.001 | 0.0004 | 0.001 | 0.01 | 0.002 | 0.0007 | 0.0001 | 0.0015 | EXAMPLE |
| 42 | 0.0051 | 0.5 | 4.0 | 1.7 | 0.3 | 0.001 | 0.0004 | 0.001 | 0.01 | 0.002 | 0.0007 | 0.0001 | 0.0028 | EXAMPLE |
| 43 | 0.0051 | 0.5 | 4.0 | 1.7 | 0.3 | 0.001 | 0.0004 | 0.001 | 0.01 | 0.002 | 0.0007 | 0.002 | 0.0028 | EXAMPLE |
| 44 | 0.0051 | 0.5 | 4.0 | 1.7 | 0.3 | 0.001 | 0.0004 | 0.001 | 0.01 | 0.002 | 0.0007 | 0.0001 | 0.0035 | COMPARATIVE EXAMPLE |

TABLE 2

| | COMPOSITIONS (MASS %) | | | | | | | | | | | |
|---|---|---|---|---|---|---|---|---|---|---|---|---|
| SAMPLE | C | Cr | Si | Al | Mn | S | N | W | Mo | Ti | Nb | V |
| 45 | 0.0051 | 0.5 | 4.0 | 1.7 | 0.3 | 0.001 | 0.0004 | 0.001 | 0.01 | 0.002 | 0.0007 | 0.002 |
| 46 | 0.0051 | 0.5 | 4.0 | 1.7 | 0.3 | 0.001 | 0.0004 | 0.001 | 0.01 | 0.002 | 0.0007 | 0.002 |
| 47 | 0.0051 | 0.5 | 4.0 | 1.7 | 0.3 | 0.001 | 0.0004 | 0.001 | 0.01 | 0.002 | 0.0007 | 0.002 |
| 48 | 0.0051 | 0.5 | 4.0 | 1.7 | 0.3 | 0.001 | 0.0004 | 0.001 | 0.01 | 0.002 | 0.0007 | 0.002 |
| 49 | 0.0051 | 0.5 | 4.0 | 1.7 | 0.3 | 0.001 | 0.0004 | 0.001 | 0.01 | 0.002 | 0.0007 | 0.002 |
| 50 | 0.0051 | 0.5 | 4.0 | 1.7 | 0.3 | 0.001 | 0.0004 | 0.001 | 0.01 | 0.002 | 0.0007 | 0.002 |

| | COMPOSITIONS (MASS %) | | | | | | | |
|---|---|---|---|---|---|---|---|---|
| SAMPLE | Zr | Cu | Sn | Ni | Sb | REM | Ca | APPENDIX |
| 45 | 0.0028 | 0.1 | 0.0001 | 0.0002 | 0 | 0 | 0 | EXAMPLE |
| 46 | 0.0028 | 0.0005 | 0.05 | 0.0002 | 0.0002 | 0 | 0.0002 | EXAMPLE |
| 47 | 0.0028 | 0 | 0 | 0.2 | 0.0002 | 0 | 0 | EXAMPLE |
| 48 | 0.0028 | 0.0001 | 0.0001 | 0.0001 | 0.08 | 0 | 0 | EXAMPLE |
| 49 | 0.0028 | 0.0001 | 0.0002 | 0.0001 | 0 | 0.0005 | 0.0001 | EXAMPLE |
| 50 | 0.0028 | 0 | 0 | 0 | 0.0001 | 0 | 0.003 | EXAMPLE |

Then, a core loss and magnetic flux density of each of the samples were measured. As the core loss, a core loss under the conditions of a 400 Hz frequency and a 1.0 T maximum magnetic flux density (W10/400) was measured. Further, an average of a value at the time of magnetization in a rolling direction and a value at the time of magnetization in a direction (sheet width direction) perpendicular to the rolling direction was calculated. Further, as the magnetic flux density, magnetic flux density under the conditions of a 50 Hz frequency and a 5000 A/m maximum magnetizing force (B50) was measured. The results are listed in the column of "before thermal treatment" in Table 3.

After the core loss and the magnetic flux density were measured, annealing at 450° C. was performed for two hours in a $N_2$ gas atmosphere. Then, a core loss and magnetic flux density of each of the samples were measured again. The results are listed in the column of "after thermal treatment" in Table 3.

TABLE 3

| | BEFORE THERMAL | | AFTER THERMAL | | |
|---|---|---|---|---|---|
| SAMPLE No. | W10/400 (W/kg) | B50 (T) | W10/400 (W/kg) | B50 (T) | APPENDIX |
| 1 | 13.4 | 1.665 | 13.4 | 1.665 | EXAMPLE |
| 2 | 13.4 | 1.664 | 13.4 | 1.664 | EXAMPLE |

TABLE 3-continued

| SAMPLE No. | BEFORE THERMAL W10/400 (W/kg) | BEFORE THERMAL B50 (T) | AFTER THERMAL W10/400 (W/kg) | AFTER THERMAL B50 (T) | APPENDIX |
|---|---|---|---|---|---|
| 3 | 13.5 | 1.662 | 14.3 | 1.661 | COMPARATIVE EXAMPLE |
| 4 | 13.7 | 1.660 | 15.9 | 1.657 | COMPARATIVE EXAMPLE |
| 5 | 15.9 | 1.687 | 15.9 | 1.687 | COMPARATIVE EXAMPLE |
| 6 | 14.6 | 1.687 | 14.6 | 1.687 | EXAMPLE |
| 7 | 13.9 | 1.635 | 13.9 | 1.635 | EXAMPLE |
| 8 | 12.6 | 1.570 | 12.7 | 1.567 | EXAMPLE |
| 9 | 12.6 | 1.569 | 13.6 | 1.565 | COMPARATIVE EXAMPLE |
| 10 | 11.9 | 1.541 | 14.9 | 1.536 | COMPARATIVE EXAMPLE |
| 11 | 13.1 | 1.627 | 15.7 | 1.627 | COMPARATIVE EXAMPLE |
| 12 | 13.1 | 1.627 | 13.4 | 1.627 | EXAMPLE |
| 13 | 13.1 | 1.627 | 13.3 | 1.627 | EXAMPLE |
| 14 | 13.1 | 1.627 | 13.2 | 1.627 | EXAMPLE |
| 15 | 13.2 | 1.627 | 13.2 | 1.627 | EXAMPLE |
| 16 | 14.1 | 1.627 | 14.1 | 1.627 | COMPARATIVE EXAMPLE |
| 17 | 13.5 | 1.602 | 13.7 | 1.598 | EXAMPLE |
| 18 | 13.5 | 1.602 | 13.7 | 1.602 | EXAMPLE |
| 19 | 13.5 | 1.602 | 13.7 | 1.602 | EXAMPLE |
| 20 | 13.5 | 1.602 | 13.7 | 1.602 | EXAMPLE |
| 21 | 13.5 | 1.602 | 13.6 | 1.602 | EXAMPLE |
| 22 | 14.3 | 1.603 | 14.3 | 1.600 | COMPARATIVE EXAMPLE |
| 23 | 16.7 | 1.604 | 16.7 | 1.599 | COMPARATIVE EXAMPLE |
| 24 | 12.6 | 1.611 | 12.8 | 1.608 | EXAMPLE |
| 25 | 12.6 | 1.611 | 12.8 | 1.611 | EXAMPLE |
| 26 | 12.6 | 1.611 | 12.8 | 1.611 | EXAMPLE |
| 27 | 12.7 | 1.611 | 12.8 | 1.611 | EXAMPLE |
| 28 | 13.1 | 1.612 | 13.6 | 1.612 | COMPARATIVE EXAMPLE |
| 29 | 13.4 | 1.639 | 13.5 | 1.636 | EXAMPLE |
| 30 | 13.4 | 1.639 | 13.5 | 1.639 | EXAMPLE |
| 31 | 13.4 | 1.639 | 13.5 | 1.639 | EXAMPLE |
| 32 | 13.5 | 1.639 | 13.5 | 1.639 | EXAMPLE |
| 33 | 14.8 | 1.640 | 14.8 | 1.640 | COMPARATIVE EXAMPLE |
| 34 | 10.9 | 1.621 | 11.0 | 1.619 | EXAMPLE |
| 35 | 10.9 | 1.621 | 10.9 | 1.621 | EXAMPLE |
| 36 | 10.9 | 1.621 | 10.9 | 1.621 | EXAMPLE |
| 37 | 10.9 | 1.621 | 10.9 | 1.621 | EXAMPLE |
| 38 | 11.5 | 1.621 | 11.5 | 1.621 | COMPARATIVE EXAMPLE |
| 39 | 10.9 | 1.595 | 11.0 | 1.595 | EXAMPLE |
| 40 | 10.9 | 1.595 | 10.9 | 1.595 | EXAMPLE |
| 41 | 10.9 | 1.595 | 10.9 | 1.595 | EXAMPLE |
| 42 | 10.9 | 1.595 | 10.9 | 1.595 | EXAMPLE |
| 43 | 10.9 | 1.595 | 10.9 | 1.595 | EXAMPLE |
| 44 | 11.3 | 1.595 | 11.3 | 1.595 | COMPARATIVE EXAMPLE |
| 45 | 10.9 | 1.602 | 10.9 | 1.602 | EXAMPLE |
| 46 | 10.9 | 1.605 | 10.9 | 1.605 | EXAMPLE |
| 47 | 10.9 | 1.604 | 10.9 | 1.604 | EXAMPLE |
| 48 | 10.9 | 1.607 | 10.9 | 1.607 | EXAMPLE |
| 49 | 10.9 | 1.611 | 10.9 | 1.611 | EXAMPLE |
| 50 | 10.9 | 1.601 | 10.9 | 1.601 | EXAMPLE |

As listed in Table 3, in the samples No. 1 to No. 2, No. 6 to No. 8, No. 12 to No. 15, No. 17 to No. 21, No. 24 to No. 27, No. 29 to No. 32, No. 34 to No. 37, No. 39 to No. 43, and No. 45 to No. 50 falling within the ranges of the present invention, it was possible to obtain low core losses before and after the thermal treatment. Specifically, before the thermal treatment, it was possible to obtain the low core losses because sufficiently large crystal grains were obtained, and after the thermal treatment, it was possible to maintain the low core losses because the precipitation of the Cr-based carbide and so on were suppressed. Further, from the result of comparison between the sample No. 43 and the samples No. 45 to No. 50, it is apparent that, when at least one kind selected from a group consisting of Cu, Sn, Ni, Sb, REN, and Ca is contained, the magnetic flux density improves.

On the other hand, in the samples No. 3 to No. 4, due to the too high C content, a large amount of a carbide precipitated in accordance with the thermal treatment and core loss deterioration was noticeable. In the sample No. 5, due to the too low Cr content, the core loss was large. In the samples No. 9 to No. 10, due to the too high Cr content, a large amount of a Cr-based carbide precipitated in accordance with the thermal treatment and core loss deterioration was noticeable. In the sample No. 11, due to the too low W content, a large amount of a Cr-based carbide precipitated in accordance with the thermal treatment and core loss deterioration was noticeable. In the sample No. 16, due to the too high W content, the core loss was large. In the samples No. 22 to No. 23, due to the too high Mo content, the core loss was large. In the sample No. 28, due to the too high Ti content, the core loss was large. In the sample No 33, due to the too high Nb content, the core loss was large. In the sample No. 38, due to the too high V content, a V-based carbide excessively precipitated to inhibit the growth of crystal grains in the recrystallization annealing and the core loss was larger than those of the samples No. 34 to No. 37, in which the contents of the components are similar except that of V. In the sample No. 44, due to the too high Zr content, a Zr-based carbide excessively precipitated to inhibit the growth of crystal grains in the recrystallization annealing, and the core loss was larger than those of the samples No. 39 to No. 43, in which the contents of the components are similar except that of Zr. Incidentally, the core losses of the samples No. 38 and No. 44 themselves are smaller than those of some of the examples of the present invention, but the effect worth the contents is not obtained and a cost increase is great.

Further, as listed in Table 3, among the samples No. 11 to No. 16 differing only in the W content, in the sample No. 11 in which the W content was less than the lower limit of the range of the present invention, core loss deterioration accompanying the thermal treatment was noticeable. From the result, it is apparent that W suppresses the core loss deterioration accompanying the thermal treatment. Further, in the samples No. 30 to No. 32 in which the W content was relatively low, because appropriate amounts of Mo, Ti, and Nb were contained, the core loss deterioration accompanying the thermal treatment was almost completely suppressed. From the result, it is apparent that, when predetermined amounts of Mo, Ti, and Nb are contained, the effect is especially large. Further, in the samples No. 34 to No. 37 and No. 39 to No. 43, the core losses were especially small because appropriate amounts of V and Zr were contained.

INDUSTRIAL APPLICABILITY

The present invention is usable in the industry manufacturing magnetic steel sheets and the industry using magnetic steel sheets, for instance.

The invention claimed is:

1. A non-oriented electrical steel sheet containing:

Cr: 0.3 mass % to 5.3 mass %;

Si: 1.5 mass % to 4 mass %;

Al: 0.4 mass % to 3 mass %;

W: 0.0003 mass % to 0.005 mass %,

C: 0.006 mass % or less,

Mn: 1.5 mass % or less,

S: 0.003 mass % or less,

N: 0.003 mass % or less, and the balance being composed of Fe and inevitable impurities.

2. The non-oriented electrical steel sheet according to claim 1, further containing at least one element selected from a group consisting of:

Mo: 0.001 mass % to 0.03 mass %;

Ti: 0.0005 mass % to 0.007 mass %; and

Nb: 0.0002 mass % to 0.004 mass %.

3. The non-oriented electrical steel sheet according to claim 1, further containing at least one element selected from a group consisting of:

V: 0.0005 mass % to 0.005 mass %;

Zr: 0.0003 mass % to 0.003 mass %;

Cu: 0.001 mass % to 0.2 mass %;

Sn: 0.001 mass % to 0.2 mass %;

Ni: 0.001 mass % to 0.2 mass %;

Sb: 0.001 mass % to 0.2 mass %;

rare earth metal: 0.0002 mass % to 0.004 mass %; and

Ca: 0.0005 mass % to 0.006 mass %.

4. The non-oriented electrical steel sheet according to claim 2, further containing at least one element selected from a group consisting of:

V: 0.0005 mass % to 0.005 mass %;

Zr: 0.0003 mass % to 0.003 mass %;

Cu: 0.001 mass % to 0.2 mass %;

Sn: 0.001 mass % to 0.2 mass %;

Ni: 0.001 mass % to 0.2 mass %;

Sb: 0.001 mass % to 0.2 mass %;

rare earth metal: 0.0002 mass % to 0.004 mass %; and

Ca: 0.0005 mass % to 0.006 mass %.

* * * * *

UNITED STATES PATENT AND TRADEMARK OFFICE

CERTIFICATE OF CORRECTION

PATENT NO. : 8,591,671 B2
APPLICATION NO. : 13/578853
DATED : November 26, 2013
INVENTOR(S) : Takahide Shimazu et al.

It is certified that error appears in the above-identified patent and that said Letters Patent is hereby corrected as shown below:

In the Specification

Column 5, line 27, change "the, precipitation" to -- the precipitation --;

Column 7-8, Table 1, change C content (mass%) of Sample No. 3, from "0.0082" to -- 0.0062 --;

Column 7-8, Table 1, change Cr content (mass%) of Sample No. 8, from "6.0" to -- 5.0 --;

Column 9-10, Table 2, with respect to samples 45-50, the columns C, Cr, Si and Al have merged, thus, replace

TABLE 2

| | COMPOSITIONS (MASS %) | | | | | | | | | | | |
|---|---|---|---|---|---|---|---|---|---|---|---|---|
| SAMPLE | C | Cr | Si | Al | Mn | S | N | W | Mo | Ti | Nb | V |
| 45 | 0.00510.5 | | 4.0.7 | | 0.3 | 0.001 | 0.0004 | 0.001 | 0.01 | 0.002 | 0.0007 | 0.002 |
| 46 | 0.00510.5 | | 4.0.7 | | 0.3 | 0.001 | 0.0004 | 0.001 | 0.01 | 0.002 | 0.0007 | 0.002 |
| 47 | 0.00510.5 | | 4.0.7 | | 0.3 | 0.001 | 0.0004 | 0.001 | 0.01 | 0.002 | 0.0007 | 0.002 |
| 48 | 0.00510.5 | | 4.0.7 | | 0.3 | 0.001 | 0.0004 | 0.001 | 0.01 | 0.002 | 0.0007 | 0.002 |
| 49 | 0.00510.5 | | 4.0.7 | | 0.3 | 0.001 | 0.0004 | 0.001 | 0.01 | 0.002 | 0.0007 | 0.002 |
| 50 | 0.00510.5 | | 4.0.7 | | 0.3 | 0.001 | 0.0004 | 0.001 | 0.01 | 0.002 | 0.0007 | 0.002 |

| | COMPOSITIONS (MASS %) | | | | | | | |
|---|---|---|---|---|---|---|---|---|
| SAMPLE | Zr | Cu | Sn | Ni | Sb | REM | Ca | APPENDIX |
| 45 | 0.0028 | 0.1 | 0.0001 | 0.0002 | 0 | 0 | 0 | EXAMPLE |
| 46 | 0.0028 | 0.0005 | 0.05 | 0.0002 | 0.0002 | 0 | 0.0002 | EXAMPLE |
| 47 | 0.0028 | 0 | 0 | 0.2 | 0.0002 | 0 | 0 | EXAMPLE |
| 48 | 0.0028 | 0.0001 | 0.0001 | 0.0001 | 0.08 | 0 | 0 | EXAMPLE |
| 49 | 0.0028 | 0.0001 | 0.0002 | 0.0001 | 0 | 0.0005 | 0.0001 | EXAMPLE |
| 50 | 0.0028 | 0 | 0 | 0 | 0.0001 | 0 | 0.003 | EXAMPLE |

"

Signed and Sealed this
Fifth Day of August, 2014

Michelle K. Lee

Michelle K. Lee
*Deputy Director of the United States Patent and Trademark Office* with

TABLE 2

| SAMPLE | COMPOSITIONS (MASS%) | | | | | | | | | | | | | | | | | | | APPENDIX |
|---|---|---|---|---|---|---|---|---|---|---|---|---|---|---|---|---|---|---|---|---|
| | C | Cr | Si | Al | Mn | S | N | W | Mo | Ti | Nb | V | Zr | Cu | Sn | Ni | Sb | REM | Ca | |
| 45 | 0.0051 | 0.5 | 4.0 | 1.7 | 0.3 | 0.001 | 0.0004 | 0.001 | 0.01 | 0.002 | 0.0007 | 0.002 | 0.0028 | 0.1 | 0.0001 | 0.0002 | 0 | 0 | 0 | EXAMPLE |
| 46 | 0.0051 | 0.5 | 4.0 | 1.7 | 0.3 | 0.001 | 0.0004 | 0.001 | 0.01 | 0.002 | 0.0007 | 0.002 | 0.0028 | 0.0005 | 0.05 | 0.0002 | 0.0002 | 0 | 0.0002 | EXAMPLE |
| 47 | 0.0051 | 0.5 | 4.0 | 1.7 | 0.3 | 0.001 | 0.0004 | 0.001 | 0.01 | 0.002 | 0.0007 | 0.002 | 0.0028 | 0 | 0 | 0.2 | 0.0002 | 0 | 0 | EXAMPLE |
| 48 | 0.0051 | 0.5 | 4.0 | 1.7 | 0.3 | 0.001 | 0.0004 | 0.001 | 0.01 | 0.002 | 0.0007 | 0.002 | 0.0028 | 0.0001 | 0.0001 | 0.0001 | 0.06 | 0 | 0 | EXAMPLE |
| 49 | 0.0051 | 0.5 | 4.0 | 1.7 | 0.3 | 0.001 | 0.0004 | 0.001 | 0.01 | 0.002 | 0.0007 | 0.002 | 0.0028 | 0.0001 | 0.0002 | 0.0001 | 0 | 0.0005 | 0.0001 | EXAMPLE |
| 50 | 0.0051 | 0.5 | 4.0 | 1.7 | 0.3 | 0.001 | 0.0004 | 0.001 | 0.01 | 0.002 | 0.0007 | 0.002 | 0.0028 | 0 | 0 | 0 | 0.0001 | 0 | 0.003 | EXAMPLE |

-- --.